US007744423B2

(12) United States Patent
Funahashi

(10) Patent No.: US 7,744,423 B2
(45) Date of Patent: Jun. 29, 2010

(54) USB CONNECTOR CONVERSION DEVICE

(75) Inventor: Takeshi Funahashi, Saitama (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/543,566

(22) PCT Filed: Jan. 7, 2004

(86) PCT No.: PCT/JP2004/000037

§ 371 (c)(1),
(2), (4) Date: Jul. 27, 2005

(87) PCT Pub. No.: WO2004/068650

PCT Pub. Date: Aug. 12, 2004

(65) Prior Publication Data

US 2006/0148310 A1 Jul. 6, 2006

(30) Foreign Application Priority Data

Jan. 29, 2003 (JP) ..... 2003-020998
Sep. 25, 2003 (JP) ..... 2003-334014

(51) Int. Cl.
*H01R 25/00* (2006.01)
*H01R 27/02* (2006.01)

(52) U.S. Cl. ..... 439/638; 439/928.1

(58) Field of Classification Search ..... 439/928.1, 439/638, 639, 170, 172, 284; 361/686; 710/310
See application file for complete search history.

(56) References Cited

U.S. PATENT DOCUMENTS

| | | | | |
|---|---|---|---|---|
| 5,955,797 | A * | 9/1999 | Kim | 307/150 |
| 6,064,566 | A * | 5/2000 | Agata et al. | 361/684 |
| 6,394,813 | B1 | 5/2002 | Stout et al. | |
| 6,466,437 | B1 * | 10/2002 | Sakuragi et al. | 361/686 |
| 6,612,874 | B1 * | 9/2003 | Stout et al. | 439/640 |
| 6,786,764 | B2 * | 9/2004 | Sivertsen | 439/502 |
| 6,843,689 | B2 * | 1/2005 | Coniff | 439/638 |
| 6,905,374 | B2 * | 6/2005 | Milan | 439/752.5 |
| 6,908,324 | B1 * | 6/2005 | Morley et al. | 439/218 |
| 6,991,483 | B1 * | 1/2006 | Milan et al. | 439/171 |
| 7,419,393 | B2 * | 9/2008 | Milan | 439/171 |

FOREIGN PATENT DOCUMENTS

| | | |
|---|---|---|
| JP | 3077518 | 6/2000 |
| JP | 2001-69165 | 3/2001 |
| JP | 2001-166858 | 6/2001 |
| JP | 2001-352661 | 12/2001 |
| JP | 2002-258745 | 9/2002 |
| WO | WO 02 056154 | 7/2002 |
| WO | WO 02/065268 | 8/2002 |

* cited by examiner

*Primary Examiner*—Chandrika Prasad
(74) *Attorney, Agent, or Firm*—Frommer Lawrence & Haug LLP; William S. Frommer; Thomas F. Presson

(57) ABSTRACT

The present invention is directed to a connector converting device adapted for connecting a host unit having a plug to an external unit through a cable. The connector converting device is connected to the host unit having a first plug serving as data input/output interface to and from an external unit. The connector converting device comprises a first jack to which the first plug is connected, and a second jack to which a second plug of the cable of the external unit is connected, wherein the first jack and the second jack are electrically connected.

6 Claims, 9 Drawing Sheets

USB CONNECTOR CONVERSION DEVICE

TECHNICAL FIELD

The present invention relates to a USB equipment using USB (Universal Serial Bus) as interface, and more particularly to a USB connector converting device for converting shape of connector of USB in USB equipment.

This Application claims priority of Japanese Patent Application No. 2003-020998, filed on Jan. 29, 2003, and Japanese Patent Application No. 2003-334014, filed on Sep. 25, 2003, the entireties are incorporated by reference herein.

BACKGROUND ART

USB is widely popularized as interface with external peripheral equipments of PC (Personal Computer). As USB equipment using USB as interface, various USB devices are proposed, and are actually used.

Among these USB devices, recording media provided with USB as interface with PC have file system at the recording media to have ability to perform management of data by the file system, and to have excellent portability. From this fact, it is expected that such recording media will be widely popularized as new media. Such recording media provided with USB as interface with PC perform data transmission/reception to and from PC through USB.

Meanwhile, in apparatuses adapted for handling personal information such as PC, a fingerprint collation apparatus adapted for performing fingerprint collation to thereby perform certification of user to permit use of the apparatus is proposed in the Japanese Patent Application Laid Open No. 2000-182025 publication.

This fingerprint collation apparatus is caused to be of the configuration in which a sensor unit for reading fingerprint information is separated from a collation processing unit for collating the fingerprint information which has been read by the sensor unit to connect both units by a predetermined interface cord to thereby realize user certification processing by fingerprint collation at a position remote from the PC. In view of the above, there is proposed a method in which the above-described recording media are caused to have certification processing function by bio-information to use such certification processing function for user certification of PC to thereby use the recording media as security device in using PC.

In general, USB device using USB as interface is connected to a PC serving as host equipment through USB cable. By control of the host equipment, power is supplied from the host equipment, or data communication is executed between the USB device and the host equipment.

For allowing the above-described recording media, etc. to be media having excellent portability, those recording media have the configuration such that they can be directly connected to USB jack that the PC has without intervention of the USB cable. Namely, recording media have the configuration provided with USB plug adapted to be USB jack that the PC has as the USB connector.

However, there are instances where it becomes very difficult to utilize USB jack that the PC has depending upon (machine) type of the PC and/or place where PC body provided with USB jack is installed (provided), etc. For example, in the desktop PC of the tower type, in the case where the USB jack is located at the rear surface of the PC body, and/or in the case such that there is limitation in the environment where user places (installs) PC so that USB jack is disposed at the position where the USB device cannot be connected, USB device provided with USB plug could not be utilized unless the USB cable is used.

Moreover, recording media caused to have, e.g., fingerprint collation processing function as certification processing function by bio-information are required to put finger with respect to fingerprint sensor of the corresponding recording medium which has been directly connected to PC. For this reason, there is the problem such that the USB connector of PC is damaged by pressing of finger, there is the problem such that since position of the USB jack is different in dependency upon (machine) type of PC, there may exist PCs of the structure in which it is impossible to put finger onto the fingerprint sensor, and there is the problem such that even in the case where finger can be put, it is impossible to perform precise collation processing.

In order to avoid such problems, it is required for permitting use position of the USB device to be freely changed to perform connection with the PC by the USB cable as described above.

However, since both ends of the USB cable have plug shape in the USB standard, it is impossible to connect USB device having USB plug and PC through USB cable.

DISCLOSURE OF THE INVENTION

An object of the present invention is to provide a novel USB connector converting device which can solve problems that prior arts as described above have.

Another object of the present invention is to provide a USB connector converting device which permits connection to external equipment through USB cable in the USB equipment having USB plug.

The USB connector converting device according to the present invention is directed to a USB connector converting device adapted for connecting to a USB equipment having a first USB (Universal Serial Bus) plug serving as data input/output interface to and from an external unit, which comprises a first USB jack to which a first USB plug is connected, and a second USB jack to which a second USB plug that a USB cable connected to the external unit has is connected, wherein the first USB jack and the second USB jack are electrically connected.

Another USB converting device according to the present invention is directed to a USB connector converting device adapted to be connected to portable recording media, including a first USB (Universal Serial Bus) plug serving as data input/output interface to and from an external unit, memory means for performing management of data by a predetermined file system to store the data, and bio-certification processing means for performing certification processing by bio-information, which comprises a first USB jack to which the first USB plug is connected, and a second USB jack to which a second USB plug that a USB cable connected to the external unit has is connected, wherein the first USB jack and the second USB jack are electrically connected.

The USB connector converting device according to the present invention permits the external unit and the USB equipment to be connected through the USB cable, thereby making it possible to easily connect the USB equipment having first USB plug in which connection to the external unit has been difficult to the external unit through a normal USB cable determined by the standard.

Moreover, the USB connector converting device according to the present invention is adapted to connect the first USB plug of the USB device into the first USB jack in carrying USB device, thereby making it possible to protect the exposed first USB plug.

Further, the USB connector converting device according to the present invention is provided with a first USB jack connected to a first USB plug that each recording medium has is connected, and a second USB jack to which a second USB plug that USB cable connected to the external unit has is connected, thus making it possible to connect the external unit and each recording medium through USB cable in performing bio-certification by bio-certification processing means of each recording medium. Accordingly, at the time of certification processing by bio-certification processing means of each recording medium, it becomes easy to dispose the recording medium at an arbitrary position. For this reason, precise bio-certification processing can be executed. In addition, the USB cable is used, thereby making it possible to prevent damage of USB interface of the external unit, which takes place in the case where corresponding medium is directly connected to the external unit to execute bio-certification processing.

Still further objects of the present invention and practical merits obtained by the present invention will become more apparent from the description of the embodiments which will be given below with reference to the attached drawings.

BEST MODE FOR CARRYING OUT THE INVENTION

The USB connector converting device according to the present invention will now be described in detail with reference to the attached drawings.

First, prior to explanation of the USB connector converting device according to the present invention, USB device which is adapted to connect the connector converting device will be explained.

Figure 1:
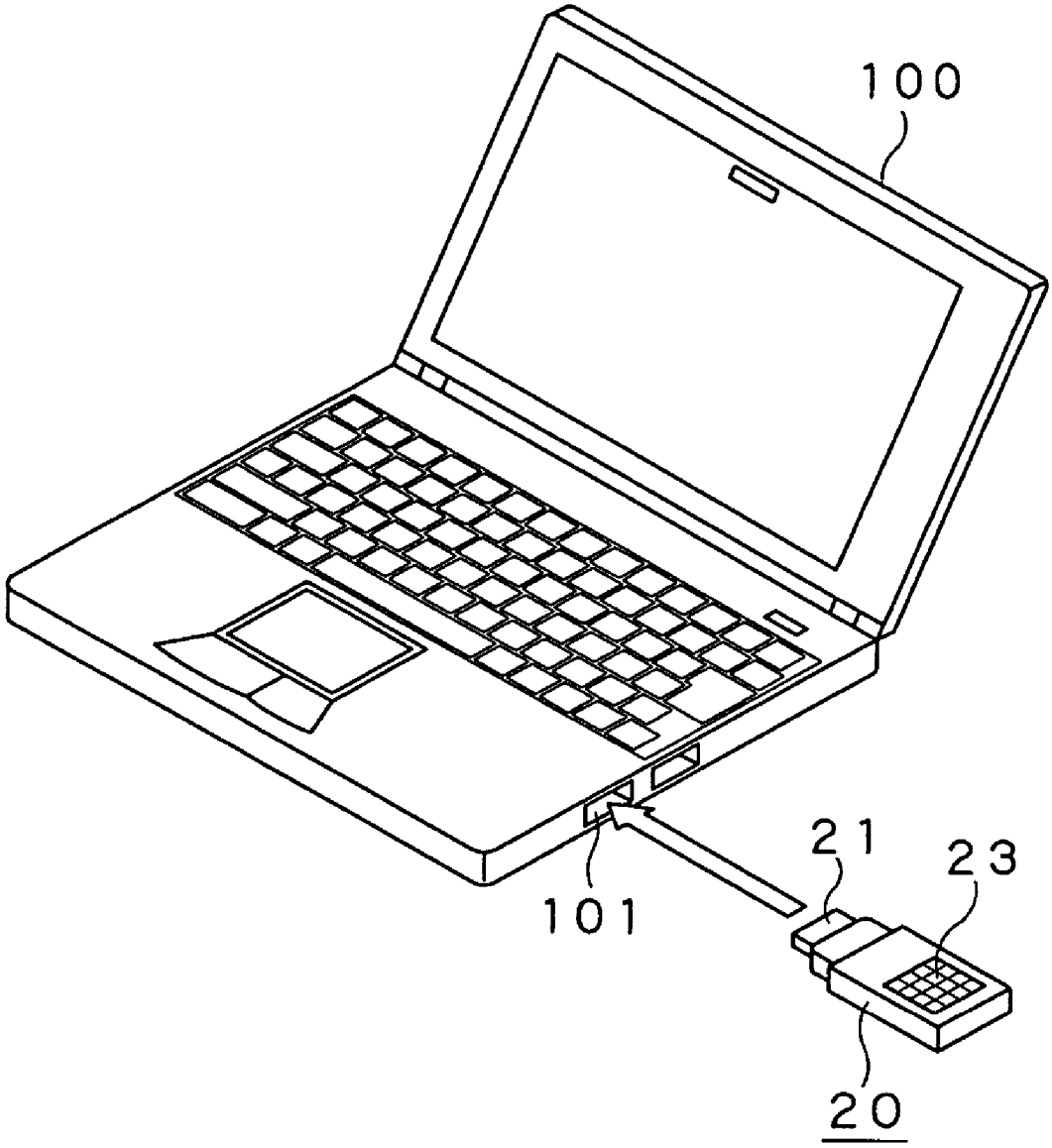
FIG. 1 is a perspective view showing the state where recording medium is directly connected to PC.

As the USB device, there is mentioned, e.g., a recording medium 20 as shown in FIG. 1.

As shown in FIG. 1, the recording medium 20 can be used by inserting a USB plug 21 that the recording medium 20 has into a USB jack 101 that a PC (Personal Computer) 100 has. In the case where the recording medium 20 is used as data storage, the recording medium 20 is directly connected into the PC 100 in this way.

At the upper surface of the recording medium 20, a fingerprint reading sensor 23 for detecting fingerprint information of finger is provided as shown in FIG. 1. Thus, as described later, the recording medium 20 is permitted to be used as a fingerprint collation processing unit.

Figure 2:
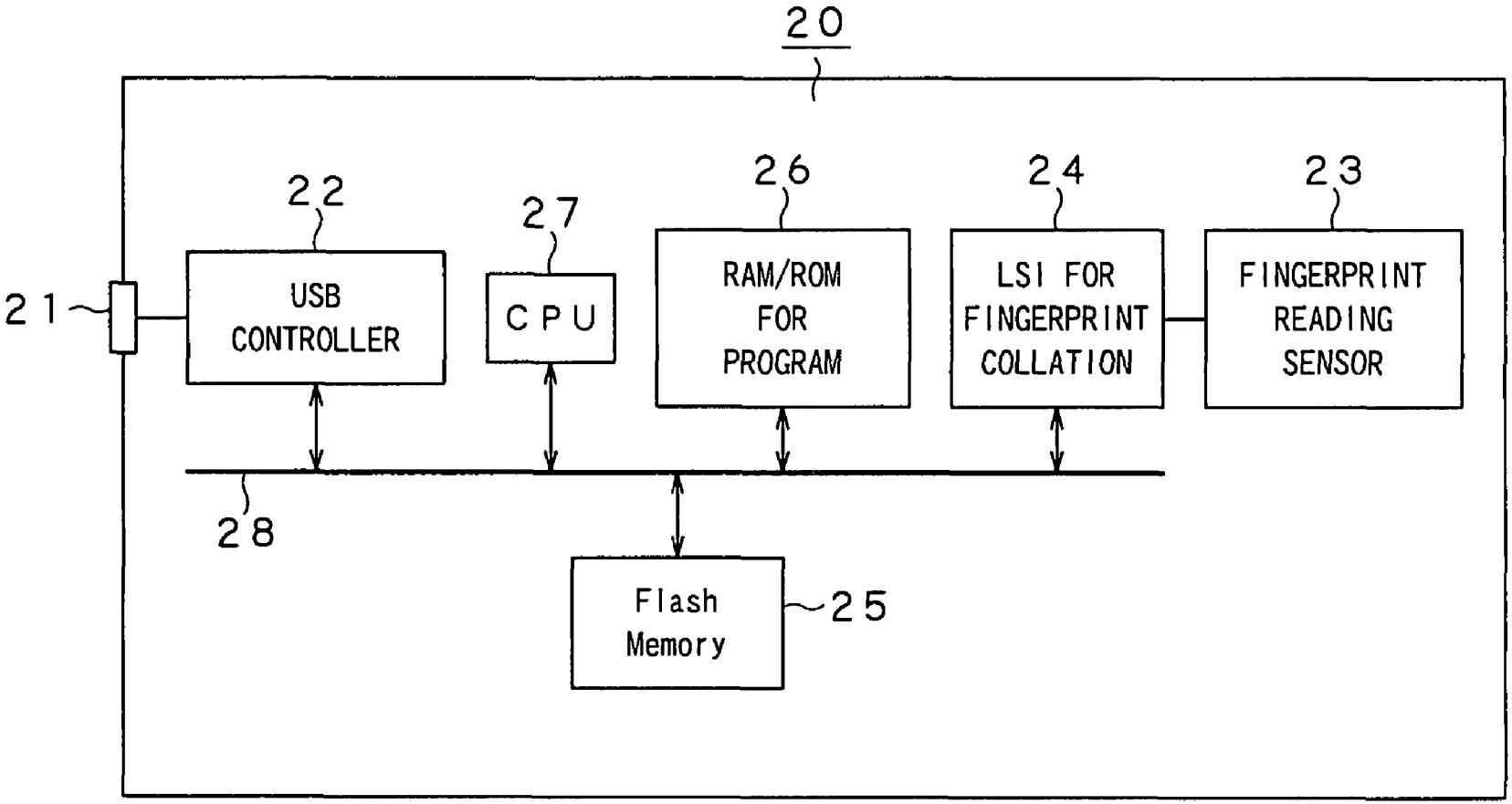
FIG. 2 is a view for explaining the configuration of the recording medium.

The configuration of the recording medium 20 will be explained with reference to FIG. 2.

The recording medium 20 comprises a USB plug 21, a USB controller 22, a fingerprint reading sensor 23, a LSI (Large Scale Integration) 24 for fingerprint collation, a flash memory 25, a RAM/ROM (Random Access Memory/Read Only Memory) 26 for program, and a CPU (central Processing Unit) 27.

The USB controller 22, the fingerprint collation LSI 24, the flash memory 25, the program RAM/ROM 26, and the CPU 27 are respectively connected through a bus 28.

The USB plug 21 is a plug for connecting to equipment of the host side, which is generally called A type plug (or series A plug). The USB plug 21 may be also Mini-A type plug prescribed by USB On-The-Go (OTG) which is the standard for directly connecting USB devices, which is instituted by the USB-IF (Universal Serial Bus Implementers Forum). The Mini—A type plug has a shape smaller than that of the A type plug, and is a plug for connecting to equipments of the host side in the same manner as stated above.

The USB controller 22 controls, on the basis of the USB protocol, data transfer between the PC 100 and the recording medium 20, which is performed through the USB plug 21.

The fingerprint reading sensor 23 is a sensor for reading mountain and valley of fingerprint, i.e., convex and concave (uneven) portions of fingerprint of finger which is mounted or put on the fingerprint reading sensor 23.

For example, the fingerprint reading sensor 23 detects uneven portions of fingerprint by the electrostatic capacity system to generate two-dimensional image. At the fingerprint reading sensor 23 of the electrostatic capacity system, electrodes are disposed at 80 μm pitch which is sufficiently finer than pitch of the uneven portions of fingerprint. The fingerprint reading sensor 23 detects uneven portions of fingerprint and quantity of charges (electrostatic capacity) stored (accumulated) between the electrodes. Since detected electrostatic capacity is low at the concave portion of fingerprint and electrostatic capacity is high at the convex portion of fingerprint, two-dimensional image representing concave and convex (uneven) portions of fingerprint is generated from the electrostatic capacity difference.

It is to be noted that the fingerprint reading sensor 23 is not limited to the fingerprint reading sensor of the electrostatic capacity system as described above, but may be also fingerprint reading sensor of the optical system, the pressure sensitive system and/or the thermal sensitive system. Fingerprint reading sensors of any detection system capable of detecting two-dimensional image indicating concave and convex (uneven) portions of fingerprint may be also employed.

At the time of fingerprint collation processing, the fingerprint collation LSI 24 serves to read out template data in which only feature portions of fingerprint image which have been stored in advance in the flash memory 25 have been extracted to perform comparative collation between fingerprint image which has been detected by the fingerprint reading sensor 23 and the template data which has been read out. The result obtained by comparative collation at the fingerprint collation LSI 24 is notified to the CPU 27.

In the flash memory 25, there is stored template data which is fingerprint information serving as reference used in fingerprint collation processing are used. In the case where fingerprint collation processing using the recording medium 20 is executed, user is required to register, in advance, fingerprint information of user himself in the flash memory 25. Fingerprint information to be stored into the flash memory 25 are template data in which feature portions of fingerprint image have been extracted.

Moreover, the flash memory 25 may be also used as data storage. The flash memory 25 is connected to the PC 100 so that the flash memory 25 functions as removal medium for the PC 100. In the case where the flash memory 25 is used as data storage, management of data file is performed by file system which has been read out from the program RAM/ROM 26 to the CPU 27.

Further, the flash memory 25 that the recording medium 20 has may comprise a memory area such that read-out operation of stored data can be performed in accordance with fingerprint collation result based on fingerprint collation processing by the fingerprint reading sensor 23 and the fingerprint collation LSI 24.

The CPU 27 executes firmware stored in the program RAM/ROM 26 to supervisorily control the operation of the recording medium 20. The CPU 27 executes fingerprint collation processing, or allows the recording medium 20 to function as data storage on the basis of firmware, for example.

Figure 3:
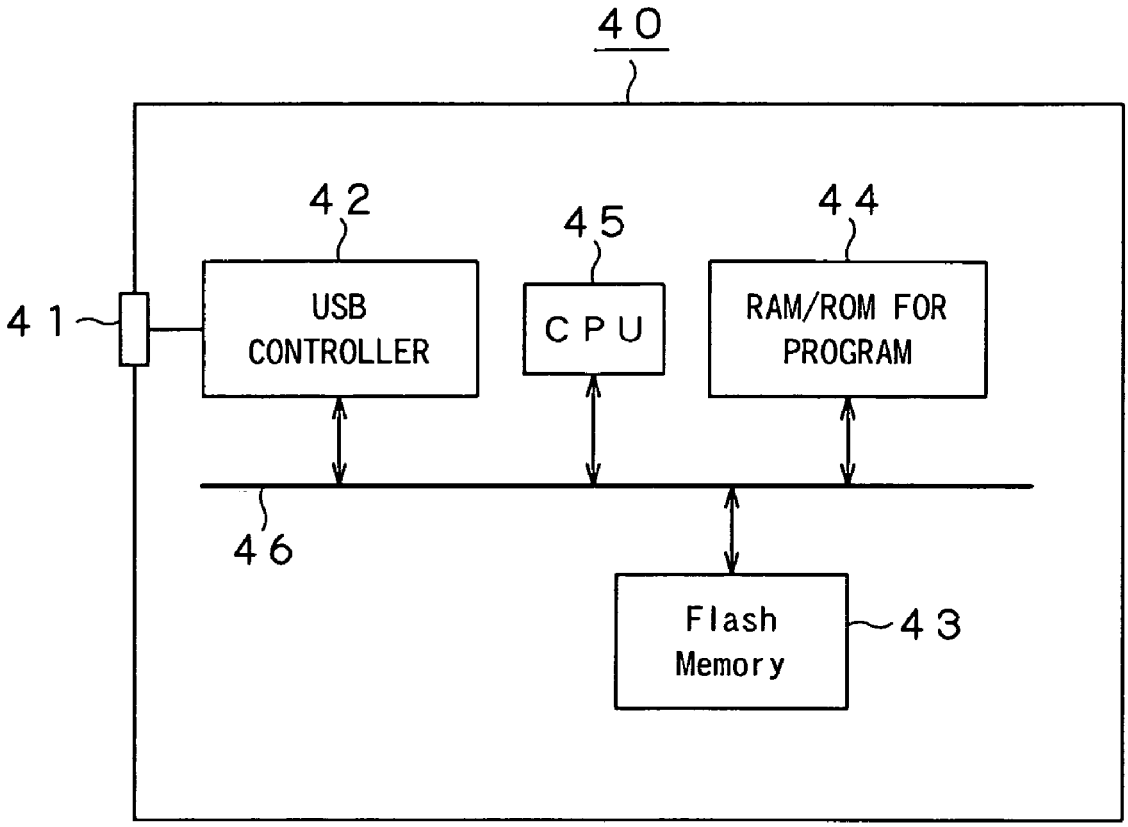
FIG. 3 is a view for explaining the configuration of recording medium having only storage function.

Moreover, as the USB device which is adapted to connect the connector converting device, there also exists, in addition to the above-described recording media 20, a recording medium 40 shown in FIG. 3 in which fingerprint collation processing function of the recording medium 20 is excluded to allow it to have only storage function so that more simple configuration is provided.

The recording medium 40 shown in FIG. 3 comprises a USB interface 41, a USB controller 42, a flash memory 43, a RAM/ROM 44 for program, and a CPU 45.

The USB controller 42, the flash memory 43, the program RAM/ROM 44 and the CPU 45 are respectively connected through a bus 46.

It is to be noted that since the USB interface 41, the USB controller 42, the flash memory 43, the program RAM/ROM 44 and the CPU 45 of the recording medium 40 respectively have exactly the same functions as those of the USB interface 21, the USB controller 22, the flash memory 25, the program RAM/ROM 26 and the CPU 27 that the above-described recording medium 20 has except for fingerprint collation processing function, their explanation will be omitted.

Figure 4:
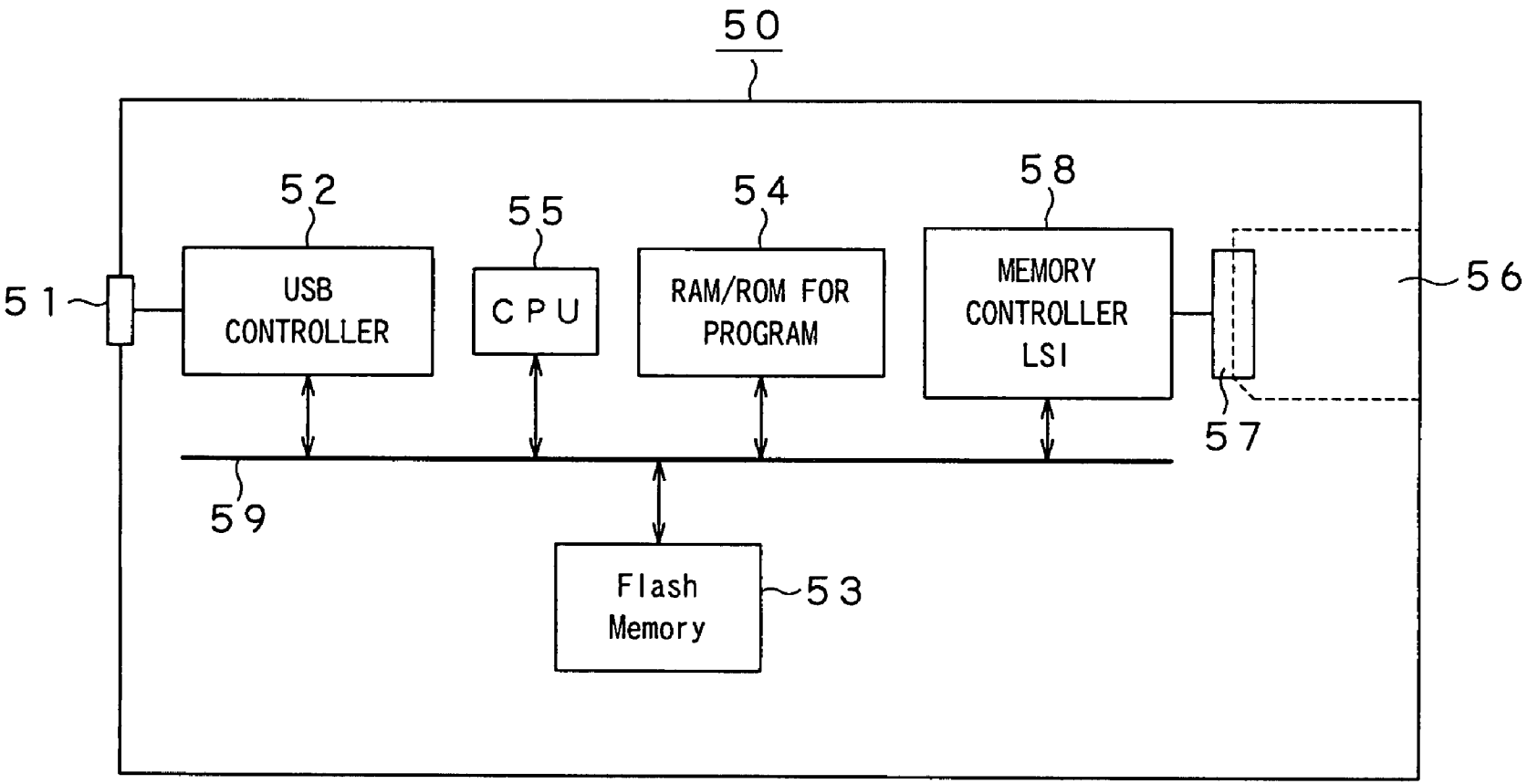
FIG. 4 is a view for explaining the configuration of recording medium having a function to load memory card.

Furthermore, as USB device which is adapted to connect the connector converting device, there also exists, in addition to the recording medium 20 and the recording medium 40 which have been described above, a recording medium 50 constituted as shown in FIG. 4 in which, e.g., memory card called memory stick (Registered Trademark) is connected to have ability to perform data transmission/reception to and from the connected memory card.

The recording medium 50 shown in FIG. 4 comprises a USB interface 51, a USB controller 52, a flash memory 53, a RAM/ROM 54 for program, a CPU 55, a memory card slot 56, a memory card interface 57, and a memory controller LSI 58.

The USB controller 52, the flash memory 53, the program RAM/ROM 54, the CPU 55, and the memory controller LSI 58 are respectively connected through a bus 59.

Memory card (not shown) is loaded into the memory card slot 56 of the recording medium 50. The memory card comprises flash memory in a manner similar to the recording medium 50, thus to have ability to perform data transmission/reception to and from external equipment. Since the connection interface of the memory card is specific interface different from USB, it is possible to perform data transmission/reception to and from only external equipment provided with interface dedicated for memory card.

When the memory card is loaded into the memory card slot 56, the memory card serves to perform data transmission/reception to and from the recording medium 50 through the memory card interface 57. Data transmission/reception of the memory card is controlled by the memory controller LSI 58.

In a manner as stated above, there are provided memory card slot 56, memory card interface 57 and memory controller LSI 58 at the recording medium 50 serving as USB device so that data transmission/reception between the memory card of the interface different from USB and external equipment having USB interface can be performed.

It is to be noted that since the USB interface 51, the USB controller 52, the flash memory 53, the program RAM/ROM 54 and the CPU 55 of the recording medium 50 have exactly the same functions as those of the USB interface 21, the USB controller 22, the flash memory 25, the program RAM/ROM 26 and the CPU 27 that the above-described recording medium 20 has except for the fingerprint collation processing function, their explanation will be omitted.

In a manner as stated above, the USB device which is adapted to connect the connector converting device is not limited to the above-described recording medium 20, there may be employed any USB devices having USB plug such as the recording medium 40 and/or the recording medium 50 which are shown as an example.

For example, if USB plug is provided at portable (mobile) camera device having image pick-up means, the connector converting device can be utilized. Thus, it is possible to perform transmission/reception of image data to and from PC, etc. serving as external unit through the connector converting device and the USB cable.

In the following description, the USB connector converting device will be explained by using recording medium 20 as USB device for convenience of explanation.

Figure 5:
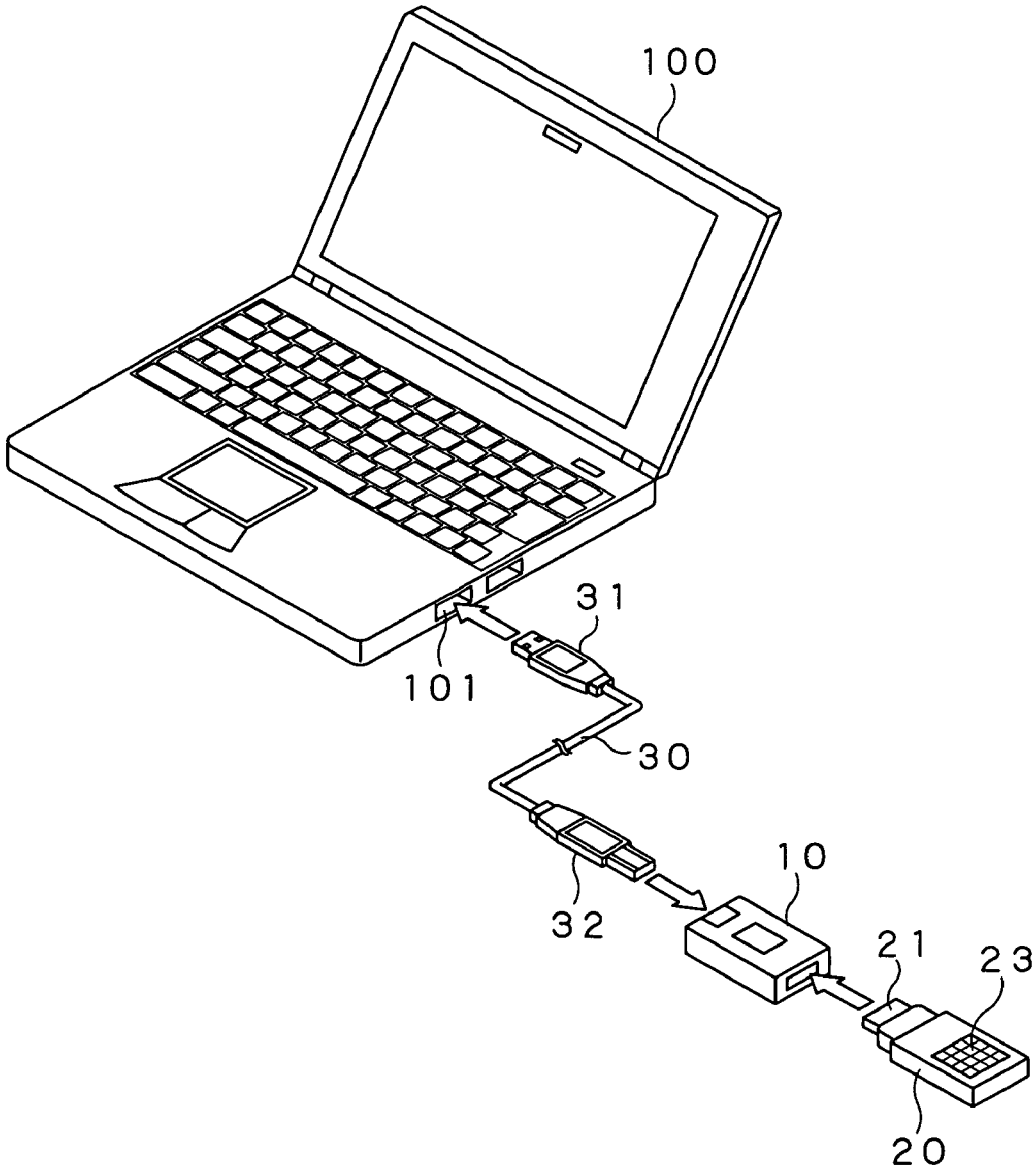
FIG. 5 is a perspective view showing the state where USB connector converting device according to the present invention is used to connect the recording medium and the PC through USB cable.

Subsequently, the USB connector converting device to which the present invention has been applied will be explained. In the case where the above-described recording medium 20 is used as a fingerprint collation processing unit as shown in FIG. 5, the recording medium 20 is connected to the PC 100 through the USB connector converting device 10 and the USB cable 30.

Figure 6:
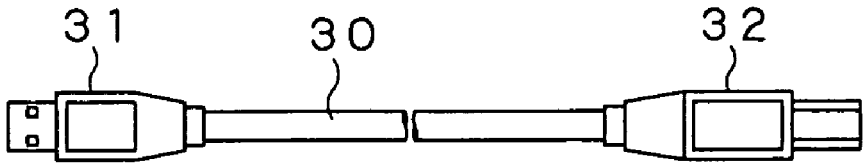
FIG. 6 is a side view showing USB cable.

As shown in FIG. 6, both ends of the USB cable 30 are plugs having shapes different from each other, wherein one plug is called A type plug (or series A plug) and the other plug is called B type plug (series B plug). In the USB cable 30, one plug is caused to be A type plug 31 and the other plug is caused to be B type plug 32. Although not shown, the terminal shape of the A type plug 31 is rectangular, and the terminal shape of the B type plug 32 is trapezoidal. The A type plug 31 is connected to the USB jack 101 of the PC 100.

In general, in the case where equipments are connected with the USB being as interface, data transfer may be executed, and/or power supply may be performed by control of the host equipment. For this reason, it is required that host equipment such as PC and the USB device are clearly distinguished.

Accordingly, in order to clearly distinguish host equipment and USB device so that host equipments and/or USB devices are not connected to each other, shapes of the connection given to the host equipment and the connector given to the USB device are entirely different from each other. Followed by this, connector shapes (plug shapes) of USB cable both ends which connect the host equipment and the USB device are different from each other as described above.

The A type plug 31 of the USB cable 30 is connected to the USB jack 101 of the PC 100. On the other hand, since the B type plug 32 of the USB cable 30 cannot be connected to the USB plug 21 of the recording medium 20, the B type plug 32 is connected through the USB connector converting device 10.

Figure 7A:
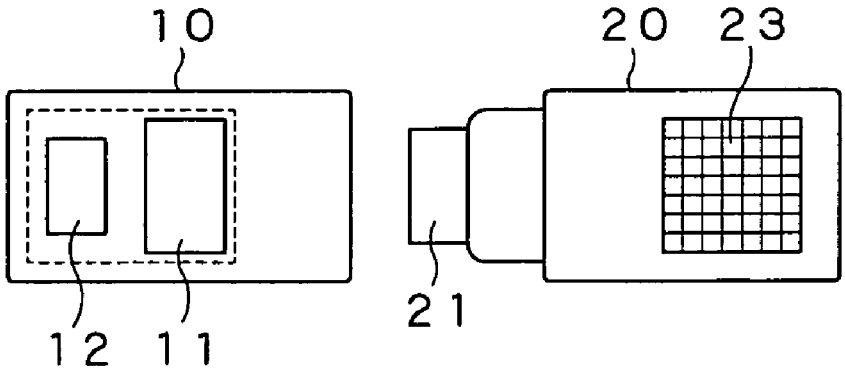
FIG. 7A is a plan view showing the USB connector converting device according to the present invention.

As shown in FIG. 7A, in the case where the USB plug 21 of the recording medium 20 is the A type plug, the USB connector converting device 10 is provided with USB jack 11 to which such plug is connected, and USB jack 12 to which B type plug 32 of the USB cable 30 is connected.

Figure 7B:
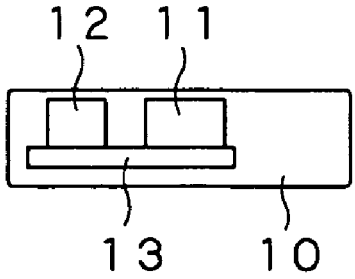
FIG. 7B is a side view thereof.

FIG. 7B is a side view of the USB connector converting device 10. As shown in FIG. 7B, the USB jack 11 and the USB jack 12 that the USB connector converting device 10 has are mounted on a printed board 13 and are electrically connected to each other.

Figure 8A:
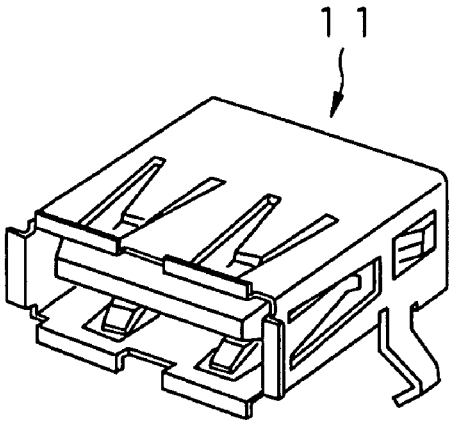
FIG. 8A is a perspective view showing outer appearance of USB jack complying with (corresponding to) A type plug that the USB connector converting device has.
Figure 8B:
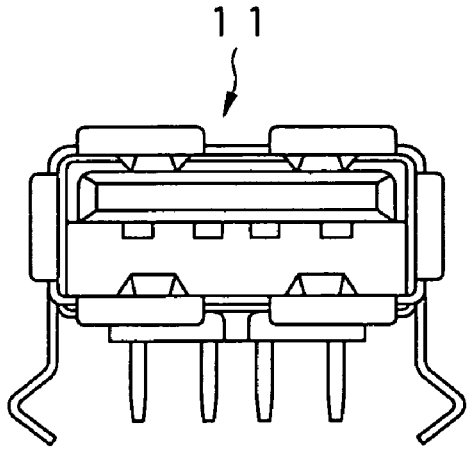
FIG. 8B is a front view showing plug insertion hole of the USB jack.

As shown in FIG. 8A, the USB jack 11 is a connector for connecting the USB plug 21 in the case of the A type plug. The front view of plug insertion hole of the USB jack 11 is shown in FIG. 8B.

Figure 9A:
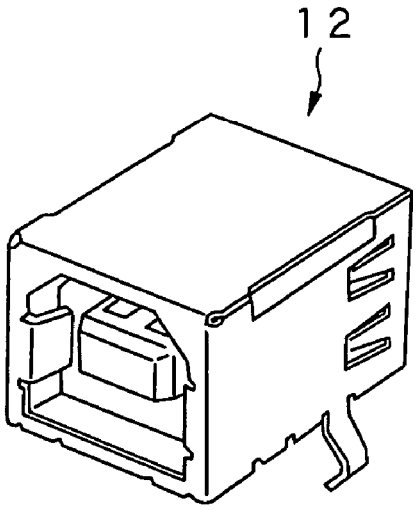
FIG. 9A is a perspective view showing outer appearance of USB jack complying with B type plug that the USB connector converting device has.
Figure 9B:
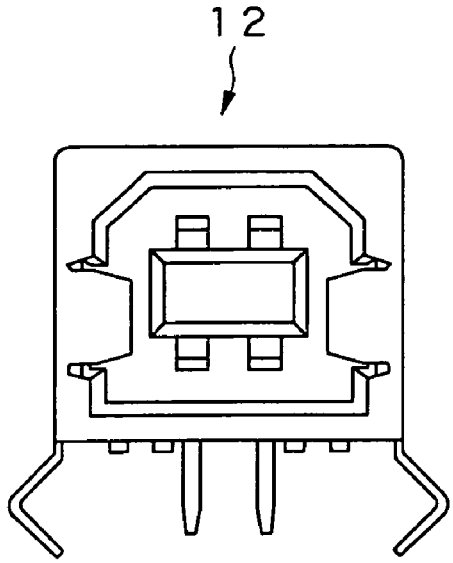
FIG. 9B is a front view thereof.

As shown in FIG. 9A, the USB jack 12 is a connector for connecting B type plug 32 of the USB cable 30. The front view of plug insertion hole of the USB jack 12 is shown in FIG. 9B.

In a manner stated above, the USB connector converting device 10 is caused to be of the configuration comprising USB jack 11 to which the A type plug can be connected, and USB jack 12 to which the B type plug can be connected. In the case where the USB plug 21 of the recording medium 20 is the A type plug, the USB plug 21 is connected to the USB jack 11, thereby making it possible to connect the recording medium 20 and the PC 100 through the USB cable 30.

In the case where the recording medium 20 is used as the fingerprint collation processing unit, the recording medium 20 and the PC 100 are connected through the USB cable 30 by using the USB connector converting device 10, whereby user can freely move the recording medium 20 to the place where he is easy to put the finger on the fingerprint reading sensor 23. Accordingly, reliable fingerprint collation can be performed, and damage of the USB jack 101 produced as the result of the fact that the recording medium 20 is directly connected to the USB jack 101 of the PC 100 can be prevented.

While the USB connector converting device 10 is provided with USB jack 11 to which the A type plug can be connected and USB jack 12 to which the B type plug can be connected as described above, the present invention is not limited to the plug type of USB, but the present invention can be applied even if the plug type of the USB cable in conformity with the USB standard used for connection with the host equipment and/or the plug type of the USB plug that the USB device has is any type.

Figure 10A:
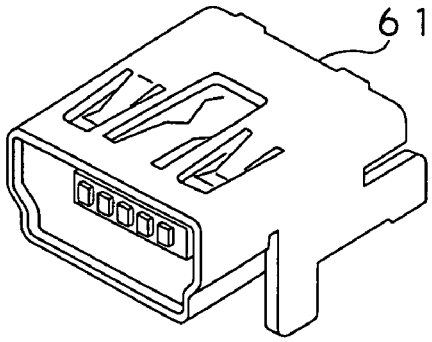
FIG. 10A is a perspective view showing outer appearance of USB jack complying with Mini-A type plug that the USB connector converting device has.
Figure 10B:
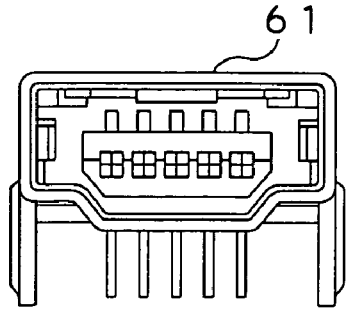
FIG. 10B is a front view showing plug insertion hole of the USB jack.

For example, as described above, there may be the case where the USB plug 21 of the recording medium 20 which is the USB device is the A type plug, or there may be the case where such USB plug 21 is Mini-A type plug. Accordingly, the USB connector converting device 10 may be also of the configuration comprising USB jack 61 to which Mini-A type plug as shown in the perspective view of FIG. 10A can be connected in place of the USB jack 11. The plug insertion hole of the USB jack 61 is shown in FIG. 10B Moreover, it is not necessarily required that USB cable used in connection with the PC 100 serving as external unit is USB cable 30 provided, at both ends thereof, with A type plug 31 and B type plug 32. For example, there may be used USB cable respectively comprising, at the both ends thereof, A type plug and Mini-B type plug, USB cable respectively comprising, at both ends thereof, Mini-A type plug and B type plug, and USB cable respectively comprising, at both ends thereof, Mini-A type plug and Mini-B type plug, etc.

Similarly to the Mini-A type plug, the Mini-B type plug is a plug prescribed by USB On-The-Go (OTG) which is the standard for directly connecting USB devices instituted by USB-IF (Universal Serial Bus Implementers Forum). The Mini-B type plug has a shape smaller than that of the B type plug. By using the Mini-B type plug, the USB device can be miniaturized.

Figure 11A:
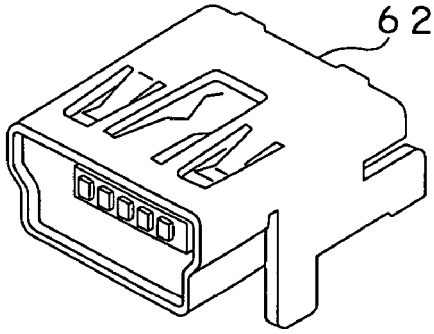
FIG. 11A is a perspective view showing outer appearance of the USB jack complying with Mini-B type plug that the USB connector converting device has, and FIG; 11B is a front view showing plug insertion hole of the USB jack.
Figure 11B:
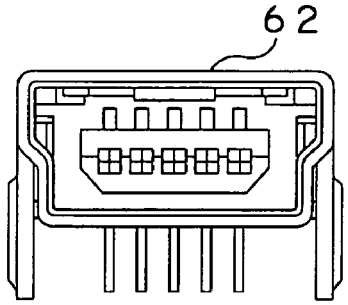

In the case where the Mini-B type plug is used for the USB cable, there may be also employed a configuration comprising USB jack 62 to which Mini-B type plug as shown in the perspective view of FIG. 11A can be connected in place of the USB jack 12 of the USB connector converting device 10 in accordance therewith. The front view of plug insertion hole of the USB jack 62 is shown in FIG. 11B.

Combination of USB jacks 11, 12, 61, 62 that the USB connector converting device 10 has can be changed in accordance with the plug type of the USB plug 21 of the recording medium 20 and the plug type of the USB cable used for connection with the PC 100.

For example, in the case where the USB plug 21 of the recording medium 20 is the A type plug, and the USB cable is provided with the Mini-B type plug, the USB connector converting device 10 is adapted to comprise USB jack 11 corresponding to the A type plug and USB jack 62 corresponding to Mini-B type plug.

Moreover, in the case where the USB plug 21 of the recording medium 20 is the Mini-A type plug, and the USB cable is provided with the B type plug, the USB connector converting device 10 is adapted to comprise USB jack 61 corresponding to the Mini-A type plug, and USB jack 12 corresponding to the B type.

Figure 12A:
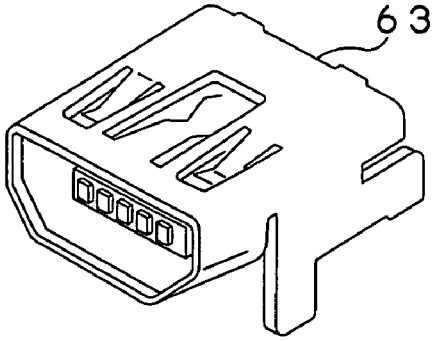
FIG. 12A is a perspective view showing outer appearance of USB jack complying with Mini-A type plug and Mini-B type plug that the USB connector converting device has.
Figure 12B:
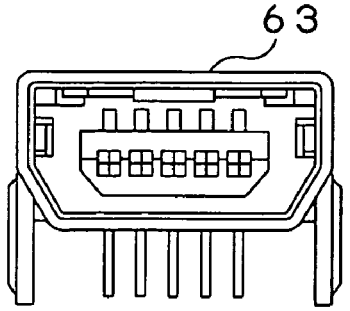
FIG. 12B is a front view showing plug insertion hole of the USB jack.

Furthermore, in the case where the USB plug 21 of the recording medium 20 is the Mini-A type plug, and the USB cable has Mini-B type plug, the USB plug 21 may comprise a USB jack 63 shown in the perspective view of FIG. 12A which can be connected to both the Mini-A plug type and the Mini-B plug type which are prescribed by the above-described USB ON-The-Go (OTG). The front view of plug insertion hole of the USB jack 63 is shown in FIG. 12B.

The USB jack 63 which can be connected to both the Mini-A plug type and the Mini-B plug type is a connector used in the case where USB device primarily clearly differently classified (positioned) from the host equipment is caused to have function of the host equipment, etc. The USB device having functions of the host equipment and the peripheral equipment in this way is called Dual role Device.

In the case where USB devices functioning as such Dual role Device are connected to each other, the USB connector converting device 10 is caused to comprise USB jack 63, e.g., in connection between printer provided with USB jack and USB plug serving as Mini-A type plug, thereby permitting connection by the USB cable.

Meanwhile, since the USB plug 21 that the recording medium 20 has is the male type connector, the USB plug 21 is projected from the recording medium 20. However, the USB connector converting device 10 is loaded into the recording medium 20, thereby also making it possible to protect the USB plug 21. Namely, the USB connector converting device 10 also functions as protective cap in carrying recording medium 20 having high portability.

Figure 13A:
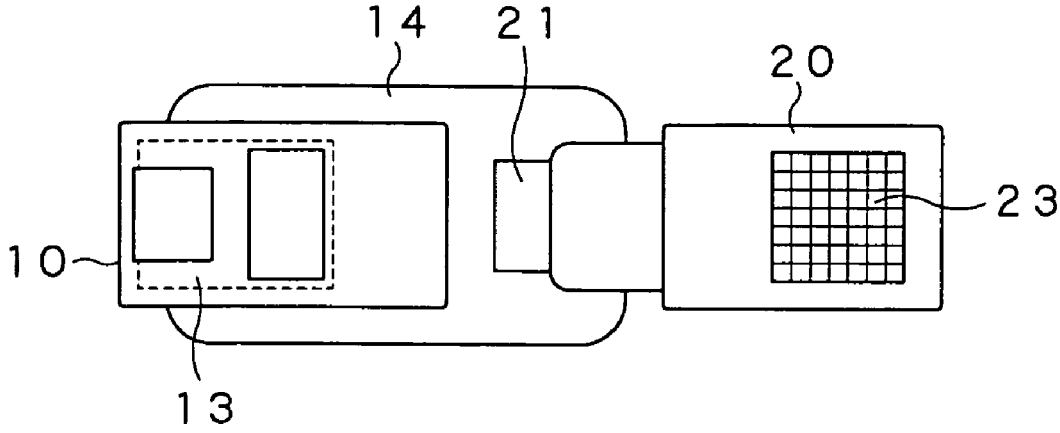
FIG. 13A is a plan view in the case where stabilization table is provided at the USB connector converting device according to the present invention.
Figure 13B:
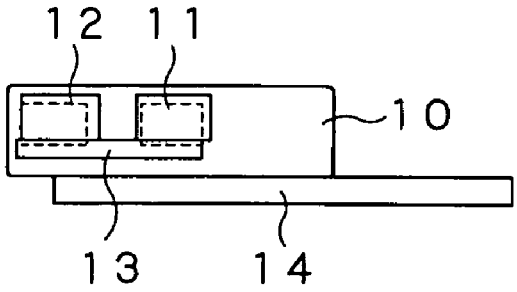
FIG. 13B is a side view in the case where first stabilization table is provided at the USB connector converting device.
Figure 13C:
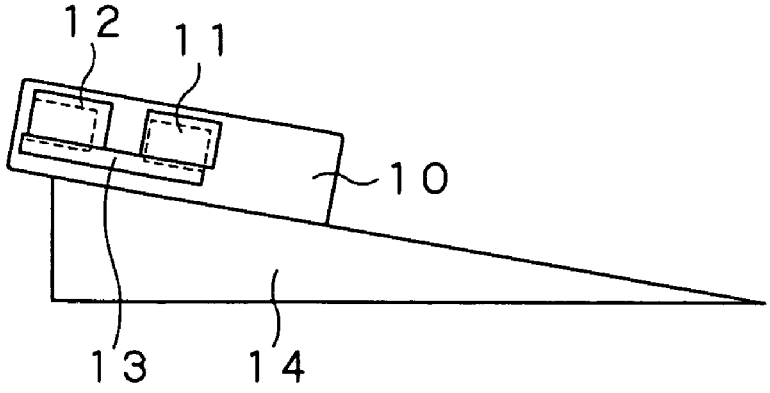
FIG. 13C is a side view in the case where second stabilization table is provided at the USB connector converting device.

Moreover, as shown in FIGS. 13A, 13B, 13C, a stabilization table 14 is provided at the bottom surface of the USB connector converting device 10, thereby making it possible to stabilize placing of finger in performing fingerprint collation processing at the recording medium 20.

In the case where the USB connector converting device 10 is connected to the recording medium 20 to mount (place) finger onto the fingerprint reading sensor 23, the stabilization table 14 provided at the USB connector converting device 10 has such dimensions to support the surface opposite to the fingerprint reading sensor 23.

FIG. 13B and 13C are side views of the USB connector converting device 10 showing variations of shapes of the stabilization table 14.

FIGS. 13B shows the case where the stabilization table 14 is constructed as a flat plate, wherein when the USB connector converting device 10 is connected to the recording medium 20, the fingerprint reading sensor 23 is disposed on the upper surface thereof.

FIG. 13C shows that the stabilization table 14 has a shape caused to have an angle to a little degree, wherein when the USB connector converting device 10 is connected to the recording medium 20, since the fingerprint reading sensor 23 is disposed in the state inclined in user direction by the above-mentioned angle, placing of finger can be more facilitated and can be stabilized.

It should be noted that while the recording medium 20 shown as an example of the USB device which is adapted to connect the USB connector converting device 10 shown as the best mode for carrying out the invention is caused to be of the configuration having fingerprint collation processing function, the recording medium is not limited to such recording medium 20, but recording medium may have certification processing function by bio-information except for fingerprint.

It is to be noted that while the present invention has been described in accordance with certain preferred embodiments thereof illustrated in the accompanying drawings and described in the above description in detail, it should be understood by those ordinarily skilled in the art that the invention is not limited to embodiments, but various modifications, alternative constructions or equivalents can be implemented without departing from the scope and spirit of the present invention as set forth by appended claims.

INDUSTRIAL APPLICABILITY

As described above, the USB connector converting device according to the present invention permits the external unit and the USB equipment to be connected through the USB cable, thereby making it possible to easily connect USB equipment having first USB plug in which connection to the external unit has been difficult to the external unit through normal USB cable determined by the standard. Further, precise bio-certification processing can be executed at the time of certification processing by bio-certification processing means of the recording media.

The invention claimed is:

1. A connector converting device for electrically connecting a first device and a second device, the connector converting device being used in a system capable of establishing an indirect connection comprising the first device, a cable, the connector converting device, and the second device, the connector converting device comprising:

the first connector jack; and a second connector jack, wherein the cable comprises a first type of plug and a second type of plug, wherein the type of a second plug is different from the type of the first plug, and wherein for a direct connection, a jack of the first device is electrically connectable to a plug of the second device, and wherein for the indirect connection;

the cable and the connector converting device are used, and wherein the first type of plug of the cable is electrically connectable to the jack of the first device, the second type of plug is electrically connectable to the first connector jack, and the plug of the second device is electrically connectable to the second connector jack, wherein the plug of the second device is a same type as a first type of plug of the cable.

2. The connector converting device as set forth in claim 1, wherein the second device is a USB device having, as the plug of the second device, a USB plug for a USB interface, and the first device is a host device having a USB jack as the connection portion.

3. The connector converting device as set forth in claim 1, wherein the connector converting device is formed so as to also function as a protective cap adapted to protect the plug of the second device.

4. The connector converting device as set forth in claim 2, wherein the connector converting device is formed so as to also function as a protective cap adapted to protect the plug of the second device.

5. The connector converting device as set forth in claim 1, wherein the connector converting device is connected to a portable recording media as the second device in which date caused to undergo management by a file system that each portable recording medium has is permitted to be read out by a collation result of a fingerprint collation means.

6. The connector converting device as set forth in claim 1, wherein in the case where a bio-certification processing means that the recording media has is adapted so the fingerprint information is caused to be the bio-information, and the recording medium includes the fingerprint sensor for allowing user to mount or put finger thereon to acquire fingerprint information, the connector converting device comprises a stabilization member for supporting plane opposite to the fingerprint sensor when the connector converting device is connected to the recording medium to mount or put finger onto the fingerprint sensor.

* * * * *